US012274324B2

(12) United States Patent
Locatelli

(10) Patent No.: US 12,274,324 B2
(45) Date of Patent: Apr. 15, 2025

(54) PROTECTIVE HELMET

(71) Applicant: Locatelli S.p.A., Almenno San Bartolomeo (IT)

(72) Inventor: Antonio Locatelli, Almenno San Salvatore (IT)

(73) Assignee: LOCATELLI S.P.A., Almenno San Bartolomeo (IT)

( * ) Notice: Subject to any disclaimer, the term of this patent is extended or adjusted under 35 U.S.C. 154(b) by 230 days.

(21) Appl. No.: 17/610,858

(22) PCT Filed: May 15, 2020

(86) PCT No.: PCT/IB2020/054635
§ 371 (c)(1),
(2) Date: Nov. 12, 2021

(87) PCT Pub. No.: WO2020/230102
PCT Pub. Date: Nov. 19, 2020

(65) Prior Publication Data

US 2022/0312883 A1 Oct. 6, 2022

(30) Foreign Application Priority Data

May 16, 2019 (IT) ..... 102019000006908
May 16, 2019 (IT) ..... 102019000006909
(Continued)

(51) Int. Cl.
*A42B 3/30* (2006.01)

(52) U.S. Cl.
CPC ..... *A42B 3/30* (2013.01)

(58) Field of Classification Search
CPC ..... A42B 3/30; A42B 3/303; A42B 3/306; A42B 3/205; A42B 3/16
See application file for complete search history.

(56) References Cited

U.S. PATENT DOCUMENTS 3,430,261 A * 3/1969 Benner ..... A42B 3/166 381/376
3,970,082 A * 7/1976 Leight ..... A42B 3/166 128/866
(Continued)

FOREIGN PATENT DOCUMENTS

EP 0019838 A1 12/1980
EP 0062163 A1 10/1982
(Continued)

OTHER PUBLICATIONS

Inernational Searching Authority: European Patent Office Search Report for corresponding International Patent Application No. PCT/IB2020/054635 dated Sep. 10, 2020, 6 pages.

*Primary Examiner* — Alissa L Hoey
(74) *Attorney, Agent, or Firm* — Patterson Intellectual Property Law, PC

(57) ABSTRACT

A protective helmet, particularly for automotive use, includes a cap adapted to wrap a portion of a user's skull and provided with a front opening in correspondence with at least a portion of a user's face and delimited by an upper edge and a first and second lateral edge of said cap, including a detachable arm for partial protection and support of a microphone reversibly fixed to said the cap at said first and/or second lateral edge, the detachable arm including a first element provided of first reversible coupling structure adapted to rigidly couple with corresponding second reversible coupling structure positioned in the cap at the first and/or second lateral edge, a second element flexibly coupled to the first element and which protrudes from it in the direction of the central and lower part of the front opening and adapted to support the microphone.

16 Claims, 13 Drawing Sheets

(30) Foreign Application Priority Data

May 16, 2019 (IT) ..... 102019000006910
May 16, 2019 (IT) ..... 102019000006914
Apr. 9, 2020 (IT) ..... 102020000007603

(56) References Cited

U.S. PATENT DOCUMENTS 4,027,341 A * 6/1977 Patteri ..... A42B 3/166 381/189
4,069,512 A * 1/1978 Palmaer ..... A42B 3/166 2/209
4,104,743 A * 8/1978 Bottger ..... A42B 3/166 2/423
4,186,447 A * 2/1980 Palmaer ..... A61F 11/14 2/209
4,347,631 A * 9/1982 Newcomb ..... A42B 3/166 381/189
4,391,000 A * 7/1983 Lonnstedt ..... A42B 3/166 2/209
4,944,361 A * 7/1990 Lindgren ..... A42B 3/166 181/129
5,208,951 A 5/1993 Aoki
5,546,610 A * 8/1996 Herzig ..... A42B 3/166 2/424
5,590,209 A * 12/1996 Pratt ..... H04R 1/083 455/100
5,742,937 A 4/1998 Baudou et al.
6,735,306 B1 * 5/2004 Heinz ..... H04R 1/1041 381/74
7,283,641 B2 * 10/2007 Rolla ..... A42B 3/166 381/376
8,028,344 B2 * 10/2011 Rogers ..... A42B 3/166 2/6.2
8,503,711 B2 * 8/2013 Flynn ..... A42B 1/245 381/376
8,688,040 B2 * 4/2014 Jung ..... A42B 3/30 455/575.2
8,739,317 B2 6/2014 Abernethy
9,124,974 B2 * 9/2015 Flynn ..... H04R 1/105
9,125,449 B1 * 9/2015 Wagemans ..... A42B 1/245
9,339,075 B2 * 5/2016 Ratliff ..... A42B 3/166
9,572,388 B2 * 2/2017 Carroll ..... A42B 3/0406
10,098,404 B2 10/2018 Morgan
10,350,113 B2 * 7/2019 Le ..... H04R 1/1066
10,362,829 B2 7/2019 Lowe
10,617,168 B2 * 4/2020 Winters ..... G02B 23/12
10,779,601 B2 9/2020 Lanner et al.
10,779,604 B2 * 9/2020 Lebel ..... A42B 3/16
10,905,593 B2 * 2/2021 Pfanner ..... A42B 3/30
10,912,344 B2 * 2/2021 Bohn ..... A42B 3/04
10,959,477 B2 * 3/2021 Nordin ..... A42B 3/166
11,337,484 B2 * 5/2022 Barber ..... H04R 1/1008
11,672,296 B2 * 6/2023 Rogers ..... G02B 23/12 2/6.2
2004/0016089 A1 1/2004 Grunberger et al.
2004/0218776 A1 * 11/2004 Rolla ..... A42B 3/166 381/376
2005/0257312 A1 11/2005 Puchalski
2006/0057972 A1 3/2006 Wikel et al.
2008/0123892 A1 * 5/2008 Latti ..... A42B 3/30 381/367
2010/0275347 A1 11/2010 Baldackin et al.
2011/0034217 A1 * 2/2011 Kushnirov ..... H04R 1/08 381/376
2011/0107503 A1 5/2011 Morgan
2012/0002046 A1 * 1/2012 Rapoport ..... G02B 27/0176 348/E7.091
2012/0060251 A1 3/2012 Schimpf
2012/0148080 A1 * 6/2012 Kushnirov ..... A42B 3/30 381/333
2012/0174294 A1 7/2012 Sackett
2013/0000015 A1 1/2013 Marzec et al.
2013/0042397 A1 2/2013 Halldin
2013/0219598 A1 * 8/2013 Pfanner ..... A42B 3/166 2/423
2013/0312161 A1 11/2013 Anderson et al.
2014/0000015 A1 * 1/2014 Arai ..... A42B 3/30 2/422
2014/0013491 A1 1/2014 Hoshizaki et al.
2015/0089722 A1 4/2015 Berry
2015/0157083 A1 6/2015 Lowe
2016/0088892 A1 3/2016 Sackett
2016/0100649 A1 * 4/2016 Glezerman ..... A42B 3/30 455/575.2
2016/0316847 A1 11/2016 Weber et al.
2016/0324248 A1 * 11/2016 Winters ..... A42B 3/04
2017/0049179 A1 * 2/2017 Nordin ..... A42B 3/166
2017/0188649 A1 7/2017 Allen et al.
2017/0215507 A1 8/2017 Straus
2018/0077990 A1 3/2018 Straus et al.
2018/0168270 A1 * 6/2018 Vaccaro ..... H04R 1/105
2018/0213874 A1 8/2018 Lanner et al.
2018/0235304 A1 8/2018 Fischer et al.
2019/0269193 A1 9/2019 Benyola et al.
2019/0320753 A1 * 10/2019 Le ..... A42B 3/0406
2021/0267300 A1 * 9/2021 Blomqvist ..... H04R 1/083
2024/0008581 A1 * 1/2024 Franzino ..... A42B 3/30

FOREIGN PATENT DOCUMENTS

GB 2005958 A * 4/1979 ..... A42B 3/30
WO 2010076817 A1 7/2010
WO 2011051989 A1 5/2011

* cited by examiner

PROTECTIVE HELMET

The present invention relates to a protective helmet, in particular an automotive helmet, and more particularly to an automotive rally helmet which is equipped with an innovative communication device. However, the helmet of the present invention can also be used in other areas.

As is known, a particular type of protective helmets for car racing is the rally helmets type which—in addition to their normal protective function—have the need to guarantee communication between the navigator and the pilot. In fact, it is known that in the practice of car rallies the navigator has the fundamental task of communicating to the driver—especially during the special stages—the indications relating to the progress of the route to follow taken from the so-called "road book". This is to allow the driver to know in advance the difficulties of the route (curves, turns, road changes, characteristics of the road surface, possible obstacles and similar indications), in order to promptly optimize the driving conditions of the car (speed, gear shifts, and the like) and driving style according to the characteristics of the stretch of road ahead.

These fundamental indications are communicated verbally by the navigator to the pilot, usually through various intercom systems for communication between the navigator and the pilot. In general, known communication devices can be grouped into two categories: helmet independent systems (for example microphones and earphones worn by the user independently and separate from the helmet) and systems integrated in the helmet, the latter being largely long preferable.

However, the devices currently in use are not fully satisfactory as they present various drawbacks, linked to the dimensions and size of the devices themselves, transmission efficiency, safety problems in the event of accidents. In fact, the requirements that intercom communication devices must be able to satisfy are many.

The transmission of the indications from the navigator to the pilot must in fact be clear and capable of overcoming the noise of the car interior. The microphone must therefore be positioned near the navigator's mouth so that the voice of the navigator is not covered or made confused by the considerable background noises present in the car interior.

At the same time, the microphone must not constitute an hindrance for the navigator (for example, constitute a visual obstacle in consulting the road book) and must not be an obstacle in fitting and removing the helmet. Above all—from a safety point of view—in the event of accidents, the communication system must be able to be removed quickly and must not cause delays or impediments to any emergency interventions that may be necessary.

At present, known communication systems have a number of problems that make their use not always optimal.

On the basis of these considerations, the main task of the present invention is to provide a communication system in automotive practice, and in particular in rallying practice, which overcomes the drawbacks and problems described above.

Within this aim, an object of the present invention is therefore to provide a protective helmet, in particular a helmet for automotive practice, in which the typical protection functions of a helmet are integrated with the communication functions between the helmet user and a third party.

Another object of the present invention is to provide a protective helmet, in particular a helmet for automotive practice, in which the quality of the voice transmission is optimal.

Another object of the present invention is to provide a protective helmet, in particular a helmet for automotive practice, which is provided with a reliable and efficient communication system.

A further object of the present invention is to provide a protective helmet, in particular a helmet for the automotive practice, which is provided with a voice communication system, and wherein said voice communication system is not a hindrance for the user.

Yet a further object of the present invention is to provide a protective helmet, in particular a helmet for the automotive practice, which does not present safety problems.

Another object of the present invention is to provide a protective helmet, in particular a helmet for automotive practice, provided with a voice communication system which allows to use various technological communication solutions.

Not least object of the subject matter of the present invention is to provide a protective helmet, in particular a helmet for the automotive practice, which has high reliability, and is easy to manufacture and at competitive costs.

This task, as well as these and other purposes which will become better apparent hereinafter, are achieved through a protective helmet, particularly for automotive use, which comprises a cap adapted to wrap around a portion of a user's skull and provided with a front opening at at least a portion of a user's face and delimited by an upper edge and by a first and second lateral edge of said cap.

The protective helmet of the present invention is characterized in that it comprises a detachable arm of partial protection and support for a microphone reversibly fixed to said cap at said first or second lateral edge, said detachable arm comprising a first element provided with first reversible coupling means adapted to rigidly couple with corresponding second reversible coupling means positioned in said cap at said first or second lateral edge, a second element flexibly coupled to said first element and which extends therefrom in the direction of the central and lower part of said front opening and adapted to support said microphone.

In fact, it has been seen that a protective helmet, particularly for automotive use, thus conceived has a set of characteristics and properties which allow to overcome the drawbacks and problems described above.

In particular, it has been found that the use of an arm which is detachable from the helmet cap as a support for a communication microphone allows to optimize both the effectiveness of the communication between the navigator and the pilot and the safety aspects.

In practice, in the protective helmet thus conceived, the microphone can be positioned at an optimal distance from the user's mouth thus allowing to obtain more than adequate clarity in communication. At the same time, the shape of the detachable arm itself, made with two elements joined together in a flexible manner (of which the first element is rigidly coupled to the cap and the second element—supporting the microphone—is movable with respect to said first element) allows to move the second element away from the first element, improving both the comfort of use and the safety aspects of devices of the known type.

Furthermore, another extremely important feature is given by the fact that the detachable arm can be quickly removed from the cap in the event of accidents or other problems, allowing immediate emergency interventions in case of need.

The shape and size of the emergency arm can also be chosen in order to ensure adequate protection for the lower part of the face (chin and mouth) of the user, in practice creating a protective chin guard for the user in the event of impacts that can occur on the front of the face, which chin guard can be detached and removed if necessary.

In the same way, the shape and size of the emergency arm can also be adapted to accommodate all or part of the electronics needed to manage communication within it, as well as the power systems (batteries or similar) of the same.

The electronics (in whole or in part) and the power supply system can also be housed in special seats made in or on the cap. In this case, the movable arm is conveniently provided with contact means, for example positioned on the first element and connectable to corresponding contact means positioned on the cap, which allow to transmit signals and/or power supply from/to the microphone.

A widely preferred embodiment of the protective helmet, according to the present invention, provides that said detachable arm comprises a third elastic element, operatively connected to said first and second elements of said detachable arm. In this case, in practice, the third elastic element can advantageously comprise a strip of flexible material which has a first and a second end respectively connected to said first and second elements of said detachable arm, allowing the movement of the second element with respect to the first element.

Alternatively, the first element of the movable arm can be made at least in part with a flexible material, so as to guarantee both rigid coupling with the shell and the mobility of the second element with respect to said first element and with respect to the helmet shell.

In a widely preferred embodiment of the protective helmet, according to the present invention, the second element of said detachable arm is advantageously pivoted on said first element and is free to rotate with respect to it.

In practice, in this embodiment, the first element acts as a support and constraint for the second element which has a degree of freedom in rotation with respect to the first element. Elastic means, for example spring means interposed between the first and second elements, or the strip of flexible material mentioned above, can be provided for controlling and modulating the movement and positioning of the second element with respect to the first element of the detachable arm.

A general and preferred embodiment of the protective helmet of the invention provides that said second element of said detachable arm is rotatably movable about a single axis of rotation between a fixed operating position with respect to said first element of said detachable arm and with respect to said cap and non-operative positions in which it is spaced forward with respect to said cap. In other words, in this embodiment of the protective helmet of the invention, the second element of the arm that supports the microphone remains in a fixed and stable operating position during normal use. In case of need, as better illustrated below, the second element of the detachable arm can be moved away from the front of the helmet, freeing the area in front of the user's mouth and chin, for example to allow emergency interventions on the same..

In a practical embodiment of the protection helmet of the invention, which will be described in detail below, said first element of said detachable arm advantageously comprises a first body which has a first end on which there are positioned the first reversible coupling means with the second reversible coupling means on the cap and a second end on which the second element of said detachable arm is pivoted.

The detachable arm further comprises a third elastic element which is operatively connected to said first and second elements of said detachable arm and which maintains said second element of said detachable arm in a fixed operating position with respect to said first element of said detachable arm and with respect to said cap (optimal position for communication). The second element of said detachable arm is therefore rotatably movable about a single axis of rotation between said fixed operating position and non-operative positions by manually acting on it and overcoming the resistance of said third elastic element to move the second element of the movable arm away from the front of the helmet.

Advantageously, in widely preferred embodiments, the detachable arm of the helmet also comprises means for adjusting said fixed operating position of said second element of said detachable arm. In practice, the detachable arm of the helmet can be conveniently provided with adjustment means, for example an adjustment screw, which limit the movement of the second element of the detachable arm with respect to the first element and the cap, determining a fixed operating point where the second element and the associated microphone are positioned at an optimal distance from the user's mouth.

Generally, the detachable arm can be positioned on the left or right side of the protective helmet.

Consequently, the second reversible coupling means can be positioned on the left or right side of the cap according to the needs.

To ensure maximum flexibility of use, it is also possible to provide embodiments of the protective helmet of the invention, wherein said second reversible coupling means are positioned in said cap in correspondence with both said first and said second lateral edge of the opening front. In practice, in this embodiment, the positioning of the detachable arm is not predetermined and possible on only one side of the helmet (right or left). The coupling means are instead positioned on both sides of the helmet, leaving the end user the possibility of choosing whether to position and use the detachable arm on the right or left side of the helmet, depending on the comfort and operating needs.

From the practical implementation point of view, the coupling between the detachable arm and the cap, in particular between the first element of the detachable arm and the protective helmet cap, can be made with various measures (snap-on couplings, bayonet couplings, various forms of attachment of a known type) according to the operational needs and the aesthetic aspect of the helmet.

For example, the second reversible coupling means can comprise a fixing plate which is positioned on the helmet cap and which is provided with a seat for housing said first element of said detachable arm.

To guarantee the speed of removal of the detachable arm, typically the protection helmet of the invention advantageously comprises means for quick release of said detachable arm which are adapted to disengage said first reversible coupling means positioned thereon by the second reversible coupling means positioned on the helmet cap. Depending on the coupling mechanism, these quick release means of said detachable arm can for example consist of levers or buttons or similar means of manual actuation by the user.

Further characteristics and advantages of the present invention will become better apparent from the description of preferred—but not exclusive—embodiments of a protective helmet, in particular a helmet for automotive use, according to the present invention, which are illustrated by way of example in the accompanying drawings, in which.

Figure 1:
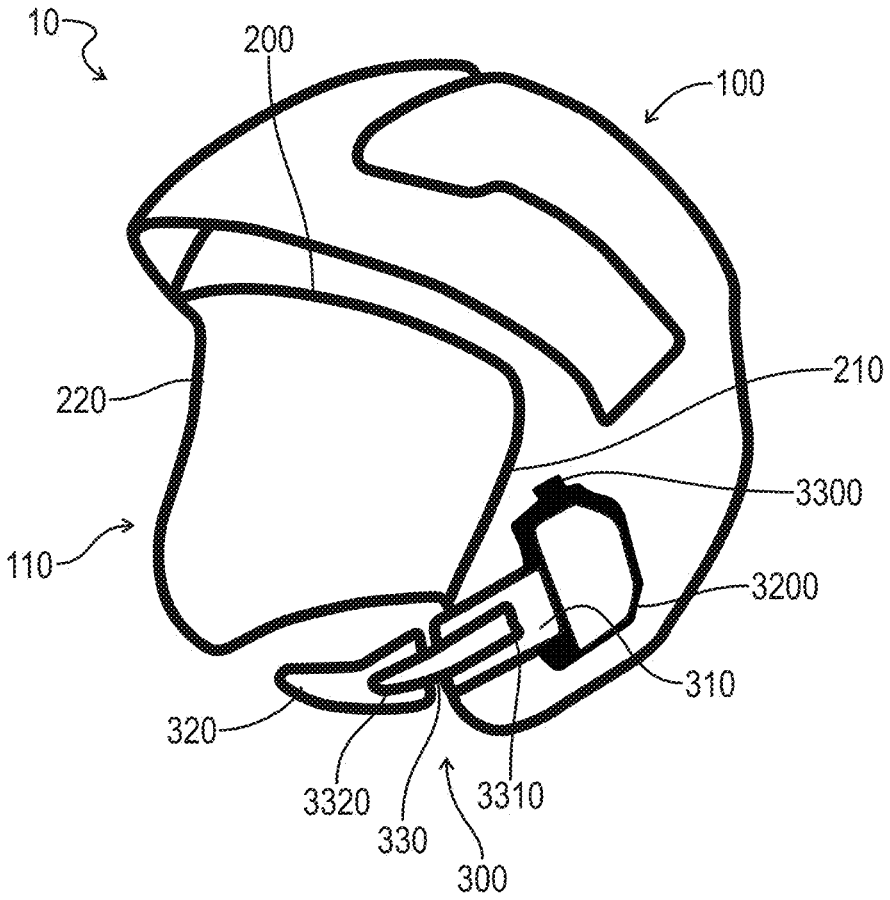
FIG. 1 shows a perspective view of a first embodiment of a protective helmet, according to the present invention, with the detachable arm in a first operating condition.

With reference to the attached figures, a protective helmet, in particular a helmet for car races, more particularly a helmet for car rallies, according to the second invention, designated in the various figures with the reference number 10, comprises, in its more general embodiment, a cap 100 which is adapted to wrap and protect the upper, rear and lateral parts of the skull of a user and which is provided with a front opening 110.

The front opening 110 is adapted to be positioned at at least a portion of the face 1000 of a user and is delimited by an upper edge 200 and by a first 210 and second 220 lateral edge of said cap 100.

One of the distinguishing features of the protection helmet 10 of the invention is given by the fact that it comprises a detachable arm 300 for partial protection and for support for a microphone which is reversibly fixed to said cap 100 at the first lateral edge 210 or at the second lateral edge 220 of the front opening 110 of the cap 100. In the illustrated embodiments of the helmet 10, the detachable arm 300 is fixed at the left lateral edge 210 of the front opening 110, but it is understood that it can also be fixed in correspondence of the right lateral edge 220 thereof.

For the present purposes, the terms "front", "top", "rear", "frontal", and "side", as well as the terms "right", "left", and "forward", as well as similar related terms, are to be understood as referring to the conditions of normal use of the helmet when worn by the user.

In the more general embodiment of the helmet 10 of the invention, said detachable arm 300 comprises a first element 310 which is provided with first reversible coupling means 3100 which are adapted to rigidly couple with corresponding second reversible coupling means 3200 positioned on the cap 100 (or in the cap 100) at said first 210 and/or on the second side edge 220 of the front opening 110. The detachable arm 300 further comprises a second element 320 which is flexibly coupled to said first element 310 and which protrudes from it in the direction of the central and lower part of said front opening 110, substantially in the area of the mouth and chin of a user.

The second element 320 of said detachable arm 300 has the main function of supporting a microphone (not shown) for communication between the user of the helmet 10 and one or more third parties. The microphone can be supported by the second element 320 according to various operating modes, and the term supported must be understood as general, including various forms of fixing the microphone on the second element 320 or housing inside it.

In the embodiment of the protective helmet 10 illustrated in FIGS. 1-4, the detachable arm 300 comprises a third element 330 having flexible characteristics which is operatively connected to the first element 310 and to the second element 320 of said detachable arm 300.

In particular, in the illustrated embodiment, the third elastic element 330 comprises a strip of flexible material which has a first end 3310 connected to the first element 310 of the detachable arm 300, and a second end 3320 respectively connected to the second element 320 of said detachable arm 300. The term "elastic" generally refers to a flexible element capable of flexing under the action of a force applied to it and of returning to its original position once the action of that force ceases and it is released.

In the embodiment of FIGS. 1-4, the second element 320 of said detachable arm 300 is pivoted on said first element 310 and is free to rotate with respect to it. In particular, the second element 320 of said detachable arm 300 is rotatably movable about a single axis of rotation between a fixed operating position with respect to said first element 310 of said detachable arm 300 and with respect to said cap 100, shown in FIG. 1, in which it is positioned at an optimal distance with respect to the face (and in particular with respect to the mouth of a user), and an inoperative position, illustrated in FIG. 2, in which it is spaced in an anterior direction with respect to said cap 100.

Figure 2:
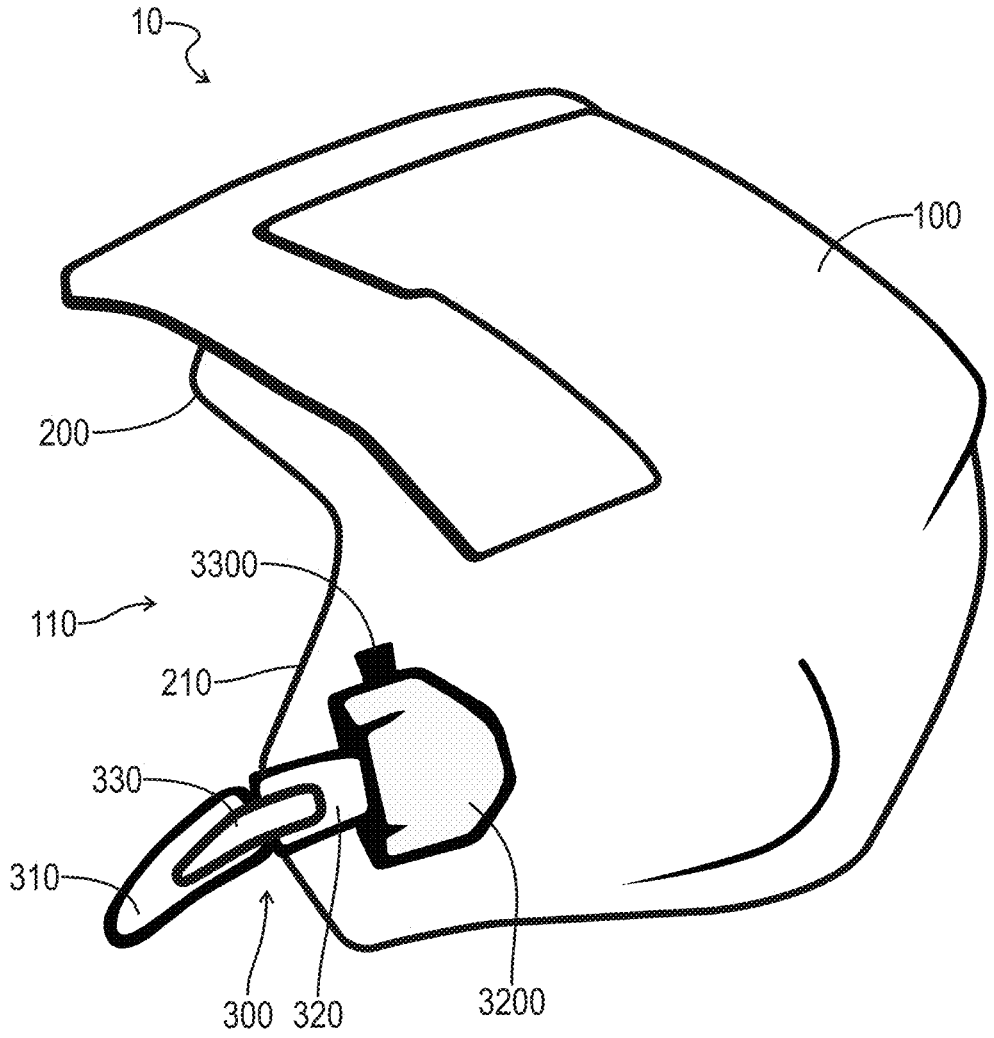
FIG. 2 shows a side view of the embodiment of a protective helmet according to FIG. 1, with the detachable arm in a second operating condition.

In practice, from the operating position of FIG. 1 in which the second element 320 and the microphone connected to it are at an optimal distance from the user's face and mouth, said second element 320 can be removed from the user's face by rotating it with respect to the first element 310 by manual action by the user, thus freeing, in case of emergency and for other reasons, the area in front of the user's mouth and chin (position of FIG. 2). When the manual action on the second element 320 is interrupted, it returns to the operating position of FIG. 1 due to the action of the third elastic element 330 on it.

Figure 3:
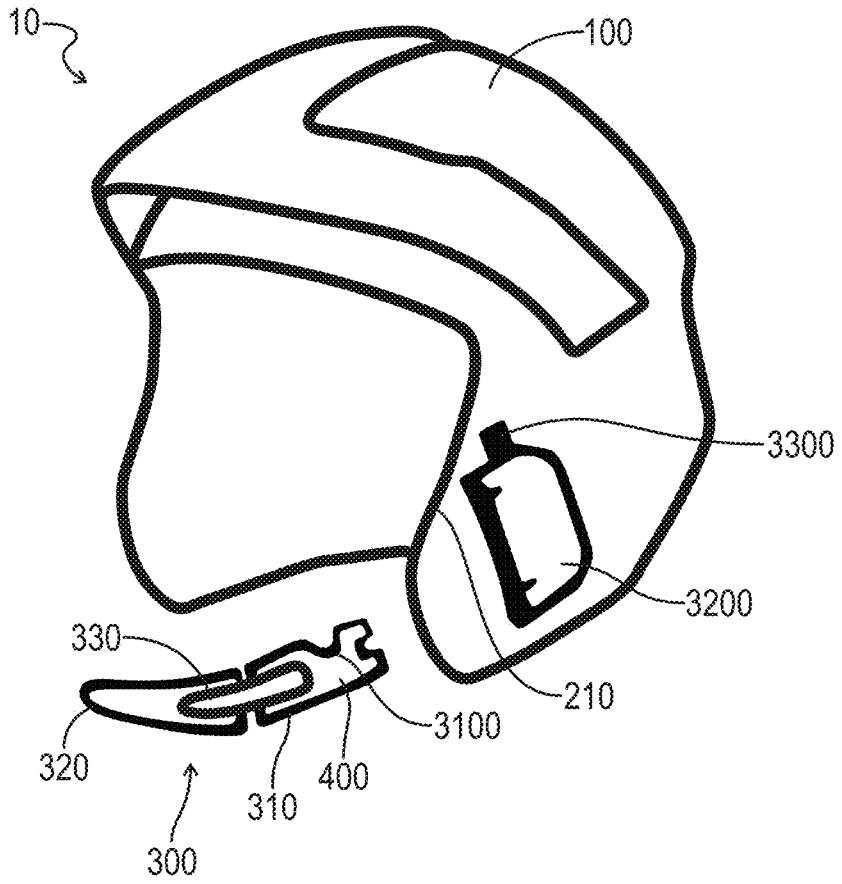
FIG. 3 shows a perspective view of the embodiment of a protective helmet according to FIG. 1, with the detachable arm in a second third non-operative condition (in which the detachable arm is separated from the helmet shell)
Figure 4:
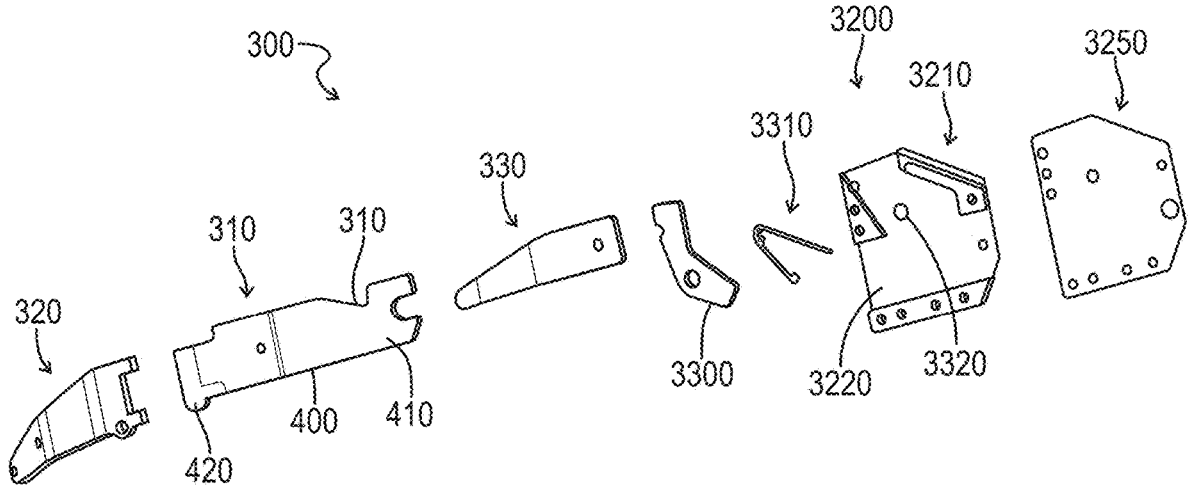
FIG. 4 shows an exploded view of some main components of a first embodiment of a detachable arm usable in a protective helmet, according to the present invention.
Figure 5:
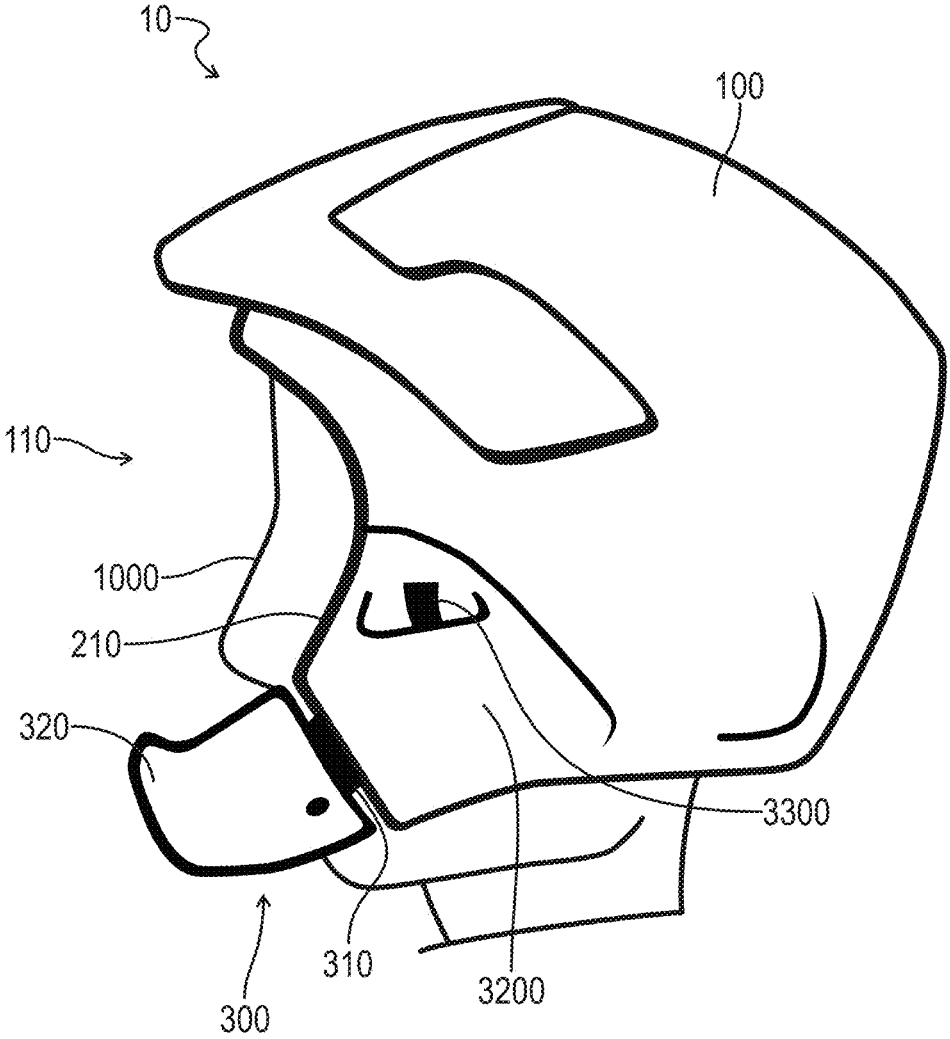
FIG. 5 shows a side view of a second embodiment of a protective helmet, according to the present invention, with the detachable arm in a second operating condition.
Figure 6:
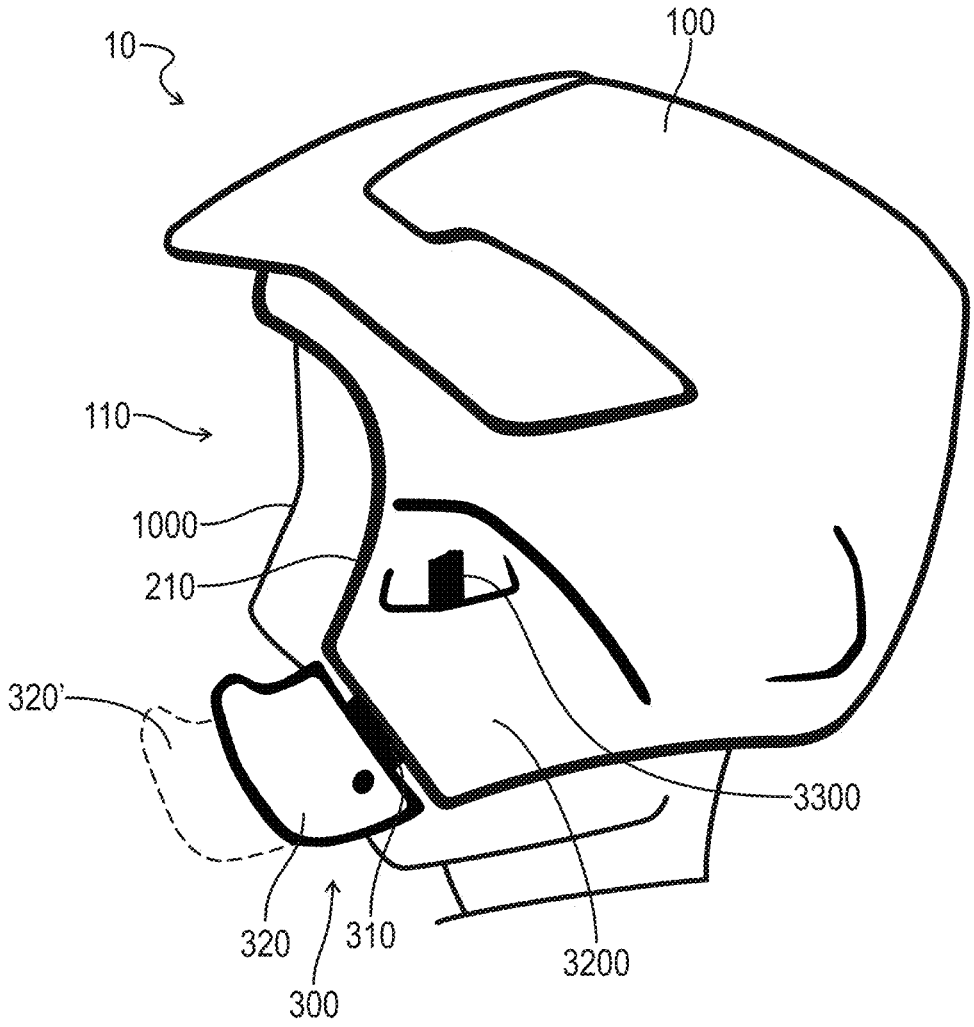
FIG. 6 shows a side view of a second embodiment of a protective helmet, according to the present invention, with the detachable arm in a first operating condition.

With particular reference to FIGS. 3 and 4, in an example of practical embodiment, the first element 310 of said detachable arm 300 comprises a first body 400 which has a first end 410 on which there are positioned said first reversible coupling means 3100 with the corresponding second reversible coupling means 3200 positioned on the cap.

The first body 400 also has a second end 420 on which said second element 320 of said detachable arm 300 is pivoted. The detachable arm 300 also includes a third elastic element 330 which is operatively connected to said first 310 and second element 320 of said arm detachable 300.

Under normal operating conditions, shown in FIG. 1, the elastic element 330 maintains the second element 320 of said detachable arm 300 in the fixed operating position with respect to said first element 310 of the detachable arm 300 and with respect to said cap 100, until when an action is exerted on it to move it to the inoperative position of FIG. 2.

The second element 320 of said detachable arm 300 is in fact rotatably movable about a single axis of rotation between the fixed operating position of FIG. 1 and the non-operative position of FIG. 2, rotating with respect to the first element 310 and overcoming the resistance of said third elastic element 330.

In the embodiment of FIGS. 1-4, the second reversible coupling means 3200 comprise a fixing plate 3210 which is positioned on said cap 100 and is provided with a housing seat 3220 of said first element 310 of said detachable arm 300. Release means 3300 of said detachable arm 300 are also positioned in the fixing plate 3210 which are adapted to disengage said first reversible coupling means 3100 from said second reversible coupling means 3200.

In the illustrated embodiment, the release means comprise a release lever 3300 pivoted on a pin 3320 positioned on the fixing plate 3210, said lever cooperating with a spring 3310. A first end of the lever 3300 cooperates with the first reversible coupling means , consisting in this case of a seat 3100 made at the first end 410 of the first body 400 of the first element 310. By acting on a second end of the lever 3300 and overcoming the resistance of the retention spring 3320, the lever 3300 rotates releasing its first end from the seat 3100, thus allowing the first body 40 to disengage from the second reversible coupling means 3200.

The detachable arm 30 can then be detached from the cap 100 by withdrawing the first body 400 of the first element 310 from the housing seat 3220, thus obtaining the configuration of FIG. 3 in which the detachable arm 300 is separated from the cap 100 of the protective helmet 10.

With reference to FIGS. 5-8, in another embodiment of the protective helmet 10 of the present invention, the first element 310 of the movable arm 300 is made at least in part with a flexible material, so as to guarantee both the coupling rigid of it with the cap 100 and the mobility of the second element 320 with respect to said first element 310 and with respect to the cap 100 of the helmet 10

In practice, as illustrated in the attached FIGS. 5-8, the first element 310 is rigidly coupled to the cap 100 by means of the reversible coupling means 3200. In normal operating conditions, the second element 320 is in the fixed position illustrated by the solid lines of FIGS. 6 and 7 and from the dotted line of FIG. 8.

Since the first element 310 is at least partially made of flexible material, rotation (or in any case movement) of the second element 320 is allowed, for example by manual action by the user, so as to remove the second element 320 from the fixed operating position and allow access to the area in front of the user's mouth and chin. In practice therefore, in non-operating conditions, the second element (indicated in this case with the reference number 320') is in the positions represented by the dotted lines of FIGS. 6 and 7, and by the solid lines of FIGS. 5 and 8.

The coupling between the first element 310 and the cap 100 can be achieved by using, for example, the same technical solutions relating to the first 3100 and second 3200 reversible coupling means, as well as relating to the release means 3300, previously illustrated for the embodiment shown in the FIGS. 1-4.

In widely preferred embodiments of the helmet 1 of the present invention, not shown in the figure, the presence of adjustment means is provided which allow to fix the fixed operating position of the second element 320 of said detachable arm 300, according to the needs.

For example, an adjustment screw can be provided that allows to fix the point of maximum approach of the second element 320 of the detachable arm 300, and consequently of the microphone associated with it, to the user's mouth. Alternative means of adjusting the position are however possible.

Furthermore, as previously mentioned, the movable arm 300 can be provided with contact means, according to the needs of electronic control, signal transmission and microphone power supply. Such contact means can for example be positioned on the first element 310 of the movable arm 300 to be coupled in operating conditions to corresponding contact means positioned on the cap 100—for example at the second reversible coupling means 3200—so as to allow the transmission of signals and/or power supply to/from the microphone.

In the embodiments of the attached figures, the movable arm 300 is positioned on the left side of the cap 100, in correspondence with the first lateral edge 210 of the front opening 110. It is understood that it is however possible to position it in correspondence with the right side of the cap, in proximity of the second lateral edge 220 of the front opening 110.

In order to maximize the flexibility of use of the protection helmet 1 of the invention it is also possible to provide that the second reversible coupling means 3200 are positioned in said cap 100 in correspondence with both the first lateral edge 210 and the second lateral edge 220 of the front opening 110. In this way the positioning side of the microphone with respect to the user's face is not predetermined but can be chosen according to needs and convenience of the user.

With reference to FIGS. 9-25, in embodiments of the present invention, the helmet 10 comprises a cap 11, suitable for wrapping at least a portion of the user's skull, and a padding 12.

The cap 11 is provided with a pair of lateral extensions 13*a*, 13*b*, in particular a left lateral extension 13*a* and a right lateral extension 13*b*, suitable to wrap at least partially the lateral parts of the face of a user, and which laterally delimit a front opening of the helmet.

In embodiments, the lateral extensions 13*a*, 13*b* can either be made as separate pieces, fixed to the cap 11, or made in a single piece with the cap 11.

The cap 11 and the lateral extensions 13*a*, 13*b* can be made of materials suitable to provide protection to the user's head in the event of an accident, for example in polymeric materials, resins, carbon fiber, or combinations thereof.

In embodiments, the helmet 10 can also comprise a padding 12, suitable for improving the fit comfort for the user and absorbing shocks and impacts associated with any accidents.

The helmet 10 further comprises a half-chin guard 14, provided on one of said lateral extensions 13*a*, 13*b*.

In the present description the expression "respective lateral extension 13*a*, 13*b*" will indicate the lateral extension 13*a*, 13*b* on which the half-chin guard 14 is mounted, thereby including the possibility that the half-chin guard 14 can indifferently be mounted on the extension. left lateral 13*a* or right 13*b*.

In embodiments, the half-chin guard 14 is cantilevered and protruding with respect to the cap 11.

In embodiments, the chin guard 14 can comprise several components, such as a coating layer, for example made of polymeric material or carbon fiber, one or more plastic bodies, which can be shaped to give the chin guard 14 appropriate shapes and sizes.

In embodiments, the chin guard 14 may further comprise a microphone and/or bodies or assemblies configured to house and/or to enslave the microphone, providing additional functionality, such as for example a filter to reduce background noise during transmission, devices to improve the quality of the audio signal, power supply cables, digital processing devices.

Figure 11:
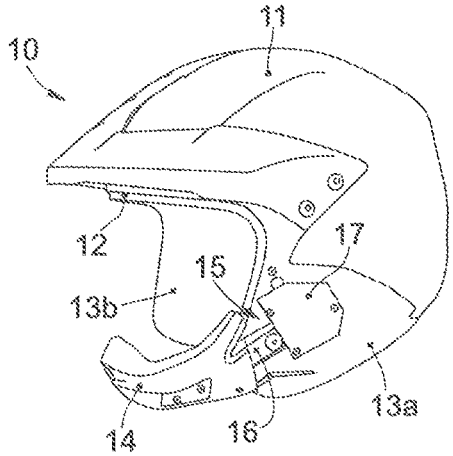
FIG. 11 is a schematic representation of a protective helmet according to embodiments of the present invention, in which, for explanatory purposes, a hooking device has been made visible.

In embodiments described by way of example in FIG. 11, the helmet 10 comprises a coupling device 15, configured to connect the half-chin guard 14 to the respective lateral extension 13*a*, 13*b*.

According to one aspect, the coupling device 15 is configured to releasably connect the half-chin guard 14 to the respective lateral extension 13*a*, 13*b*.

Figure 9:
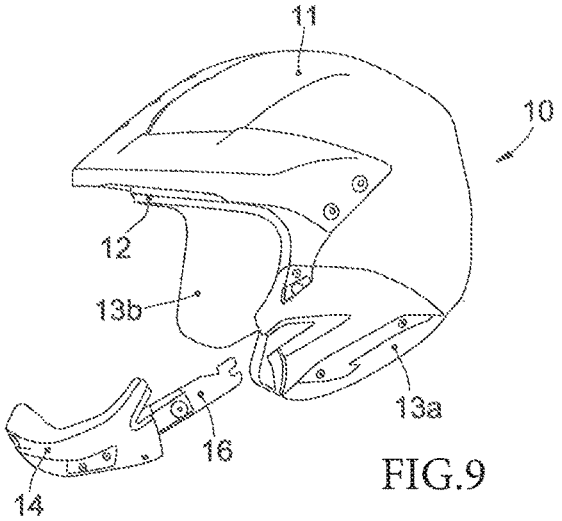
FIGS. 9, 10 and 12 are schematic representations of a helmet according to embodiments of the present invention.

By way of non-limiting example, in FIG. 9 the half-chin guard 14 is shown unhooked, or released, from the respective lateral extension 13*a*, 13*b*, while in FIG. 11 the half-chin guard 14 is shown connected, or hooked, to the respective lateral extension is shown 13*a*, 13*b*.

In embodiments, the coupling device 15 comprises a support arm 16, on which the half-chin guard 14 is fixed.

Figure 10:
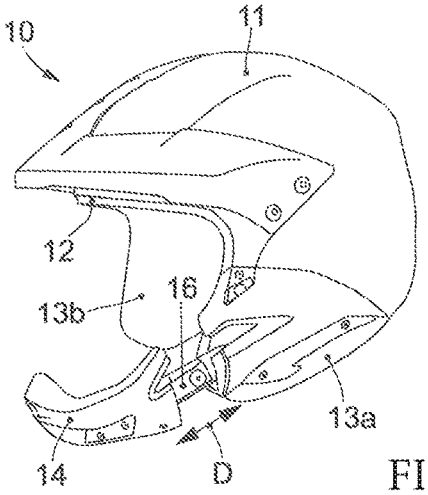

In embodiments schematically described by FIG. 10, the support arm 16 can be slidingly movable with respect to the respective lateral extension 13*a*, 13*b*, to selectively adjust a distance D between the half-chin guard 14 and the respective lateral extension 13*a*, 13*b*.

In particular, in FIG. 10, the half-chin guard 14 is connected to the respective lateral extension 13*a*, 13*b* at a distance D, which can be adjusted by moving the support arm 16 closer or further away from the respective lateral extension 13*a*, 13*b*.

Figure 14:
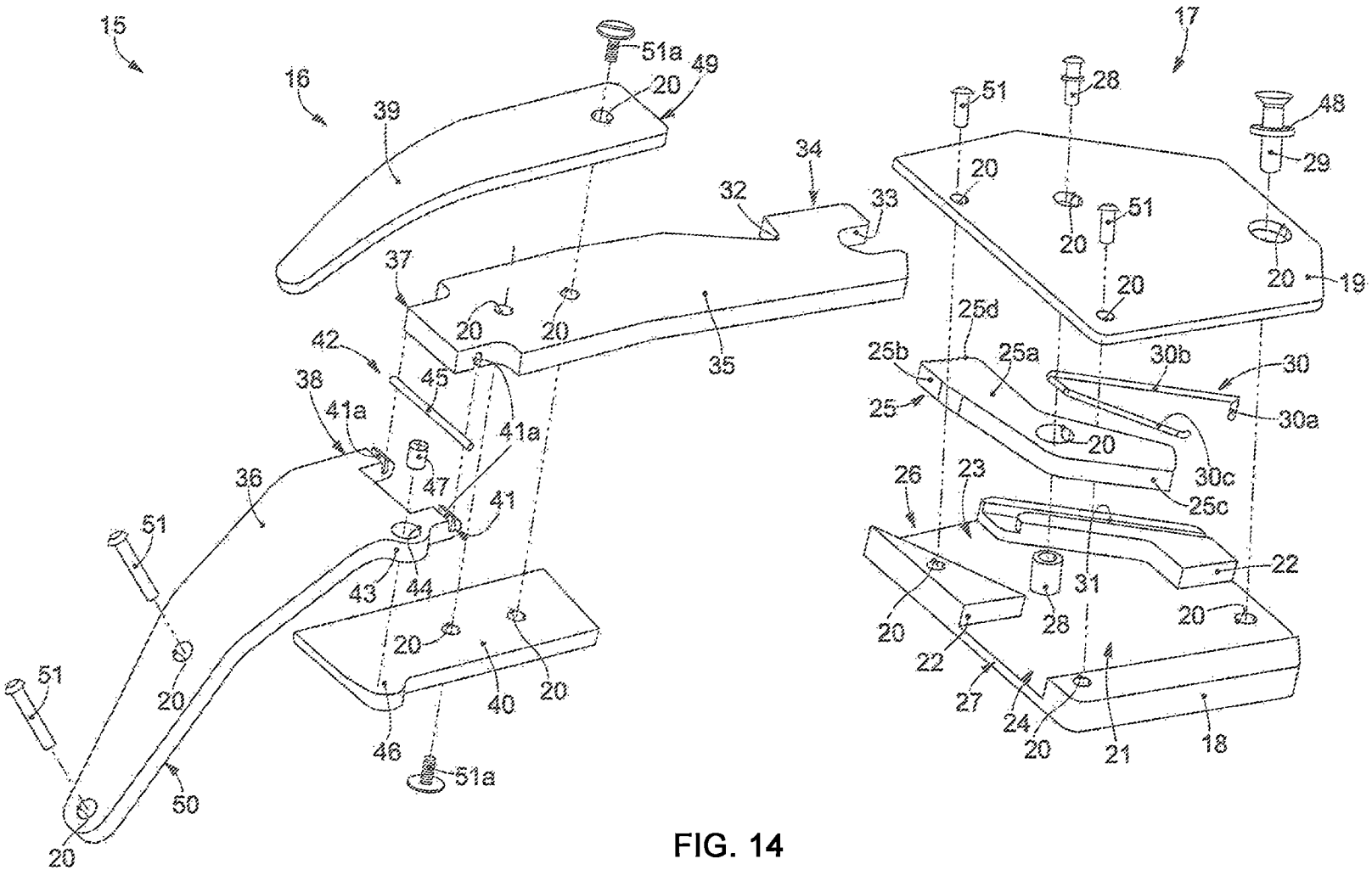
FIG. 14 is an exploded schematic view of a coupling device according to embodiments of the present invention.

In embodiments described by way of example in FIG. 14, the support arm 16 can provide a coupling portion 50, in which holes 20 are provided in which fixing means 51 are inserted to fix the chin guard 14.

The support arm 16 can also have a connecting portion 34, opposed to the coupling portion 50 and arranged to connect the support arm 16 to the respective lateral extension 13*a*, 13*b*; for this purpose, in embodiments not shown in the figures, the connecting portion 34 can have holes 20 arranged for the insertion of special fixing means 51 to fix the half-chin guard 14 to the respective lateral extension 13*a*, 13*b*.

In embodiments, the support arm 16 is made of material of suitable resistance to support the half-chin guard 14, for example metallic material.

In embodiments, the support arm 16 can be made in a single piece, for example configured as a single elongated structure.

In alternative embodiments, illustrated by way of example in FIG. 14, the support arm 16 can be made as an assembly, comprising several elements assembled together, possibly also made of different materials.

The coupling device 15 of the present invention can further comprise a housing assembly 17, arranged on the lateral extension 13*a*, 13*b* to which the half-chin guard 14 is connected.

In embodiments exemplified by FIG. 11, the housing assembly 17 stably houses the support arm 16 in a selectively removable manner.

In embodiments described by way of example in FIG. 10, the housing assembly 17 stably houses the support arm 16 in a selectively adjustable manner.

In such embodiments, the support arm 16 can be configured to define, in cooperation with the housing assembly 17, a plurality of stable positions of the chin guard 14, each having different distance D from the respective lateral extension 13*a*, 13*b*.

By way of non-limiting example, FIG. 2 shows one of such plurality of stable positions, in which the chin guard 14 is arranged at a distance D from the respective lateral extension 13*a*, 13*b*.

As shown by way of example in FIGS. 14, 15, 16, 18, the support arm 16 can be inserted, at least partially, in a chamber 21 present in the housing assembly 17.

It is therefore possible to define an insertion axis X associated with the direction of insertion of the support arm 16 into the chamber 21, and substantially corresponding with the longitudinal development of the support arm 16 and of the chamber 21.

In such embodiments, the connecting portion 34 can comprise at least one engagement seat 32, having a profile characterized by shapes, recesses, protrusions, teeth, concavities, convexities, or other forms, suitable to allow the engagement of the arm of support 16 in the housing assembly 17.

Figure 18:
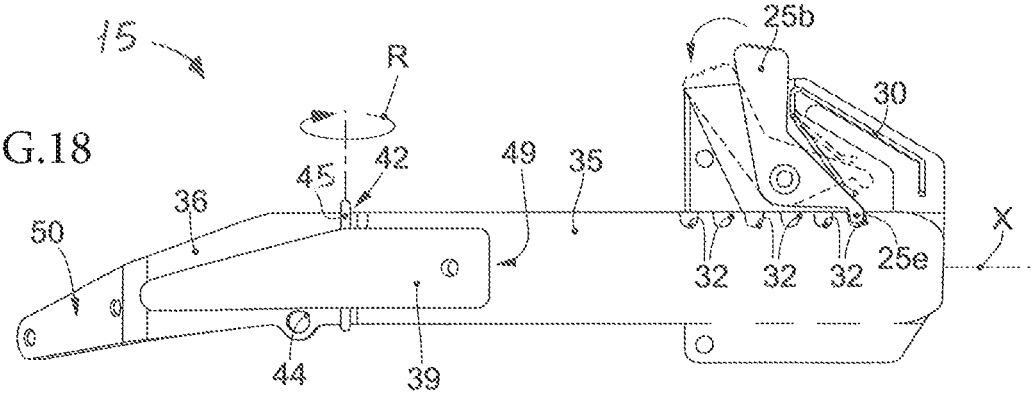
FIG. 18 is a schematic side view of a coupling device according to embodiments of the present invention.

In embodiments described by way of example in FIG. 18, a plurality of engagement seats 32 are formed in the connecting portion 34 of the support arm 16, arranged longitudinally aligned to define the plurality of stable positions of the half-chin guard 14.

With reference to the embodiments described by FIGS. 10 and 18, each of said engagement seats 32 corresponds to a determined stable position of the chin guard 14, defined by a distance D of the half-chin guard 14 with respect to the respective lateral extension 13*a*, 13*b*.

Figure 15:
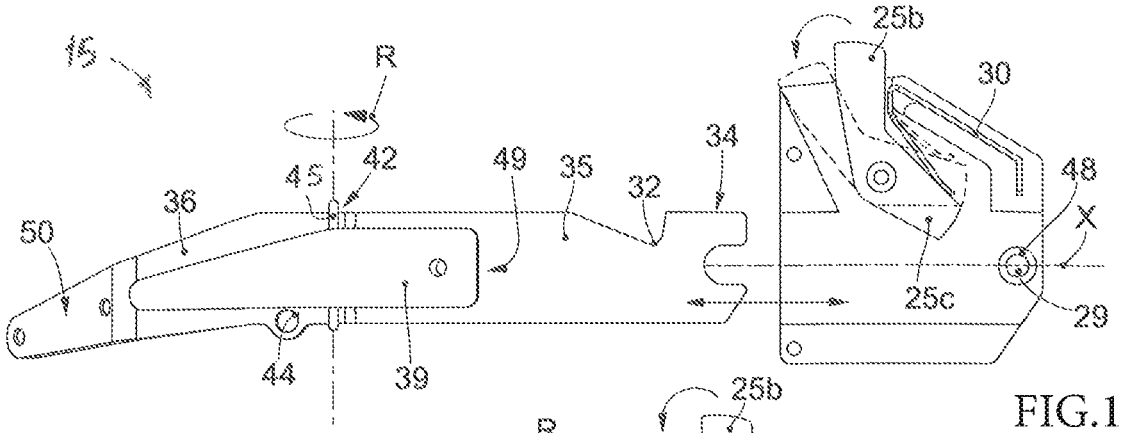
FIG. 15 is a schematic side view of a coupling device according to embodiments of the present invention.
Figure 16:
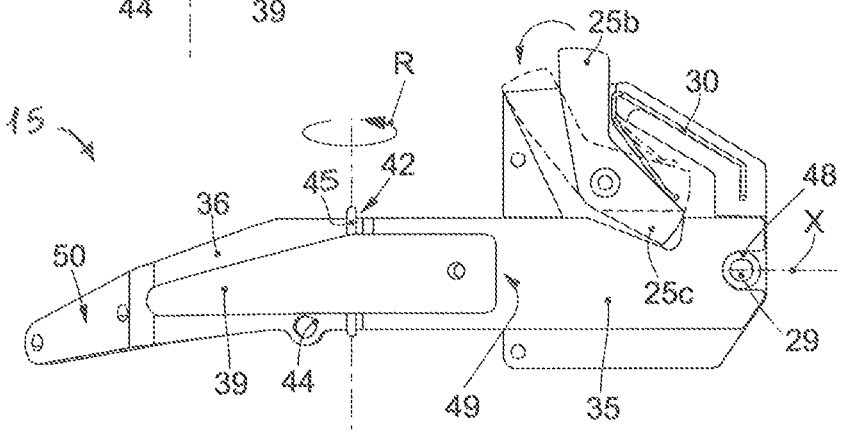
FIG. 16 is a schematic side view of a hooking device, in a hooked configuration, in accordance with embodiments of the present invention.

In embodiments described by FIGS. 14-16, the support arm 16 also has a stop portion 49, configured to come into contact with the housing assembly 17, defining an end stop for inserting the support arm 16 into the housing assembly 17.

This stop portion 49 can also be provided in the embodiments described by FIGS. 2 and 10. In these embodiments the stop portion 49 can be configured to define the limit stop of the support arm 16 in the housing assembly 17 in correspondence of the last engagement seat 32, or the closest to the coupling portion 50, to which corresponds the stable position of minimum distance D of the half-chin guard 14 from the respective lateral extension 13*a*, 13*b*.

In embodiments, the housing assembly 17 is applied to one of the lateral extensions 13*a*, 13*b* of the cap 11 by means of fixing means 51, for example screws inserted in special holes 20. In embodiments, the housing assembly 17 comprises a housing plate 18 and a closing counterplate 19, configured in such a way as to define, when fastened against each other, the chamber 21.

In embodiments, at least the support arm 16 or a portion of it is housed selectively removable inside the chamber 21.

In embodiments, at least the support arm 16 is slidably housed inside the chamber 21.

In embodiments, the housing plate 18 can be fixed to the cap 11 by means of fixing means 51, for example screws, whereby suitable through holes 20 can be present.

In embodiments, the closing counterplate 19 can be fixed to the housing plate 18 by means of fixing means 51, for example screws, whereby suitable through holes 20 can be present.

In embodiments, the housing assembly 17 comprises a locking member 25, which can be activated to selectively move from a first operating position to a second operating position.

Figure 7:
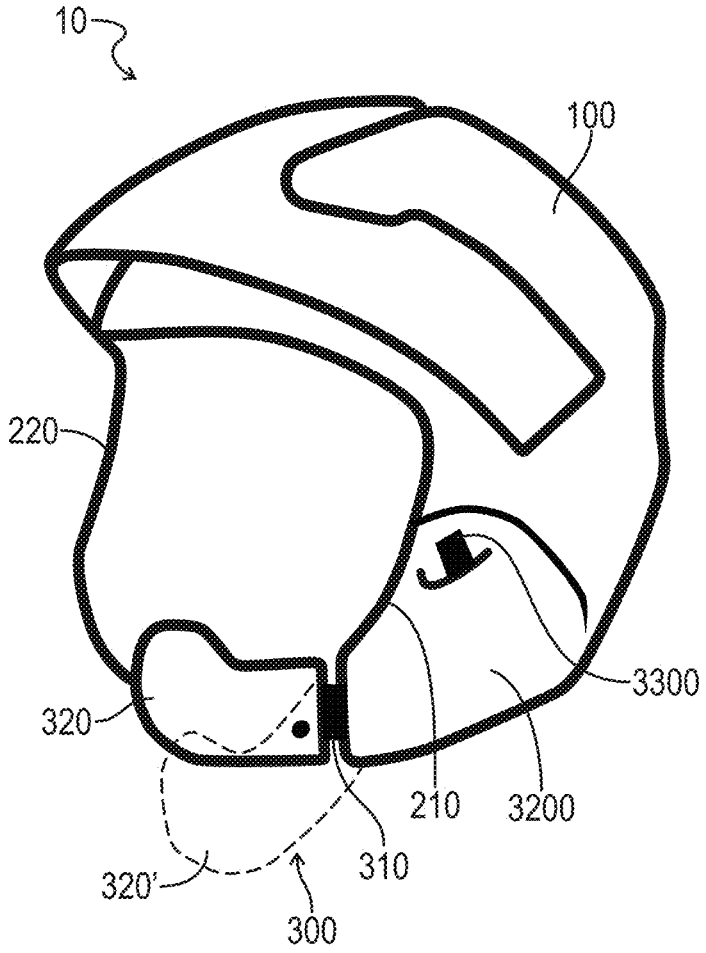
FIG. 7 shows a perspective view of a second embodiment of a protective helmet, according to the present invention, with the detachable arm in a first operating condition.
Figure 8:
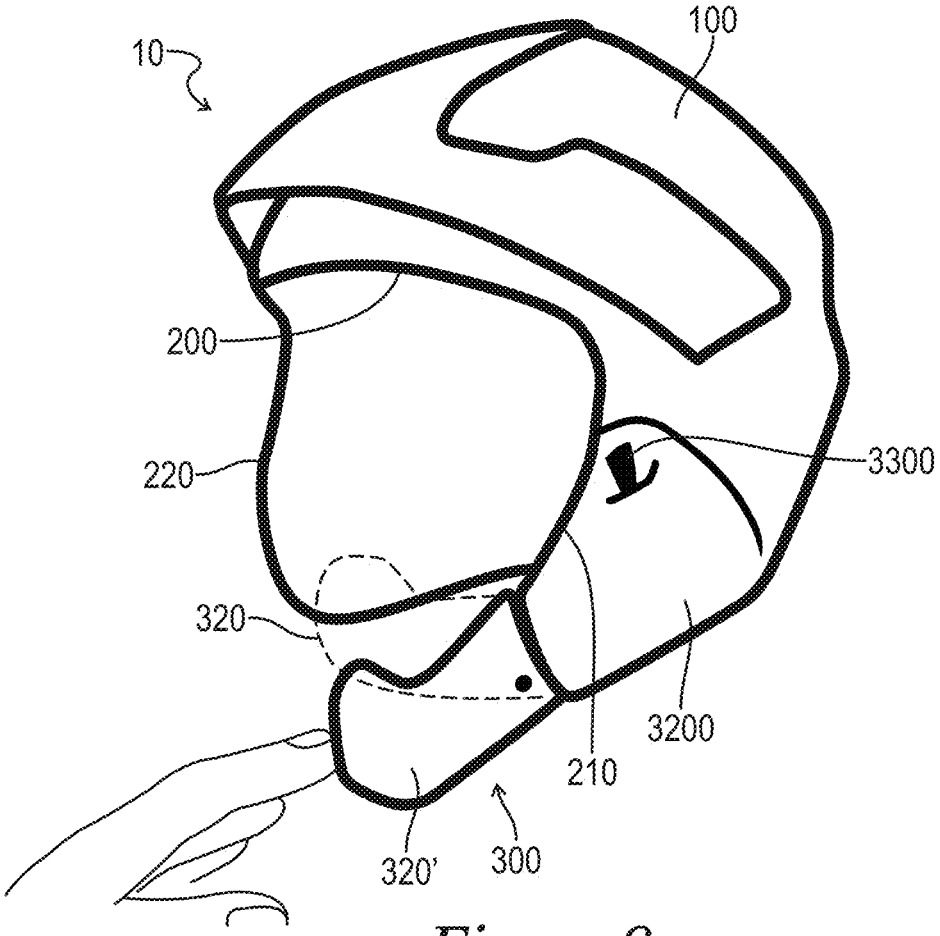
FIG. 8 shows a perspective view of a second embodiment of a protective helmet, according to the present invention, with the detachable arm in a second operating condition.

The locking member 25 in the first operating position, illustrated by way of example in a continuous line in FIGS. 7 and 8, is adapted to engage at least one of the engagement seats 32 made on the connection portion 34 of the support arm 16, constraining the support arm 16 in room 21.

In the embodiments described in FIG. 18, the locking member 25 in the first operating position is adapted to engage a selected of the engagement seats 32, constraining said support arm 16 in the chamber 21.

In such embodiments, the engagement seat 32 in which the locking member 25 is engaged therefore determines the distance D at which the half-chin guard 14 is adjusted. In such embodiments, the adjustment of the half-chin guard 14 with respect to the respective lateral extension 13*a*, 13*b* is therefore a discreet adjustment, in which it is possible to assign the half-chin guard 14 one of a plurality of stable positions.

The locking member 25 in the second operating position, illustrated by way of example in dashed lines in FIGS. 15, 16 and 18, is designed to allow the disengagement of the support arm 16 from the chamber 21.

In embodiments illustrated by way of example in FIGS. 14-16, the locking member 25 can be configured as a rotatable lever 25*a*, which has a first arm 25*b*, suitable for being operated manually by a user, and a second arm 25*c*, suitable engaging the engagement seat 32 of the support arm 16.

The rotatable lever 25*a* can also be pivoted to the housing plate 18, or even to the closing counterplate 19, by means of a special pin 28 located in a middle portion thereof.

The second arm 25*c* of the lever 25*a* can have a profile conjugated to the profile of the at least one engagement seat 32 present on the connection portion 34 of the support arm 16.

The profiles of the second arm 25*c* and of the engagement seat 32 are also configured in such a way as to prevent the retrograde movement of the support arm 16 once engaged by the locking member 25, as illustrated by way of example in FIG. 16.

In embodiments described by FIG. 10, the second arm 25*c* is adapted to engage a selected of the engagement seats 32 of the support arm 16.

Furthermore, in the embodiments described by FIG. 18, the engagement seats 32 each have a concave profile, and the second arm 25*c* has a protruding portion 25*d* with a convex profile and conjugated to the concave profile of the engagement seats 32.

In embodiments illustrated by way of example in FIGS. 14, 15, 16, 18, the housing assembly 17 further comprises an elastic element 30, for example a spring or a curved metal tongue, cooperating with the locking member 25 to maintain it normally in the first operating position.

In embodiments described by FIG. 14, the elastic element 30 comprises a coupling section 30*b*, arranged to be hooked to the chamber 21, and an operating section 30*c*, arranged to operate in contrast against a abutment surface of the second arm 25*c* of the lever 25*a*.

In embodiments, a terminal end of the elastic element 30, opposed to the operating section 30*b*, can be configured as an appendix 30*a*. This appendix 30*a* can form an angle with respect to the coupling section 30*b*, in such a way as to improve the coupling of the elastic element 30 in the chamber 21.

Other embodiments may provide that the locking member 25 and the elastic element 30 are made in a single body, for example by providing a single flexible metal tongue, of suitable shapes and dimensions, for example in the shape of a T, constrained in suitably on the walls of chamber 21.

In embodiments, the housing plate 18 and/or the closing counterplate 19 have shaped portions 22, which define in the chamber 21 a first seat 23, to house the locking member 25 in the first operating position and in the second position operational, a second seat 24, to house a portion of the support arm 16, and a third seat 31, to house at least the coupling portion 30*b* of the elastic element 30.

Such shaped portions 22 can for example comprise protrusions, steps, grooves, edges, protrusions, protuberances, raised surfaces.

The walls of the chamber 21, not necessarily regular, are therefore formed by the internal surface of the housing plate 18, by the internal surface of the closing counterplate 19 and by the shaped portions 22, as schematically illustrated in FIG. 14.

The second seat 24 of the chamber 21 therefore develops substantially along the insertion axis X, and has dimensions consistent with the dimensions of the support arm 16.

The second arm 25*c* of the rotatable lever 25*a* is further configured so that a portion thereof is in the second seat 24.

The angular excursion of the rotary movement of the rotatable lever 25*a* with respect to the axis of the pin 28 is therefore limited by the contact between the arms 25*b*, 25*c* of the rotatable lever 25*a* and the walls of the chamber 21, extending for a limited angular interval.

Furthermore, in embodiments schematically described by FIG. 14-16, a limit switch pin 29 can be provided in the second seat 24 of the chamber 21.

In such embodiments, the connecting portion 34 of the support arm 16 has a seat with a concave profile 33, of a conjugate shape for engaging the end-of-travel pin 29 when the support arm 16 is at the end of the stroke in the housing assembly 17.

In embodiments, a ring 48 is fitted on the limit stop pin 29, configured to compensate or reduce the play between the support arm 16 and the housing assembly 17, as shown by way of example in FIGS. 14 and 16.

In such embodiments, the ring 48 can be configured as an O-ring made of elastic material.

In embodiments, described by means of FIG. 15, 16, 17, 18, the support arm 16 has a stop portion 49, configured to come into contact with the housing assembly 17, defining an end stop for inserting the arm of support 16 in the housing assembly 17.

The limit stop of the support arm 16 in the housing assembly 17 can therefore be defined by the limit stop pin 29, by the stop portion 49 or by both characteristics.

In embodiments, the chamber 21 has a first opening 26, from which a portion of the first arm 25*b* of the rotatable lever 25*a* protrudes, as schematically illustrated in FIG. 9, so that it is accessible to be moved from the outside, by a user.

Figure 17:
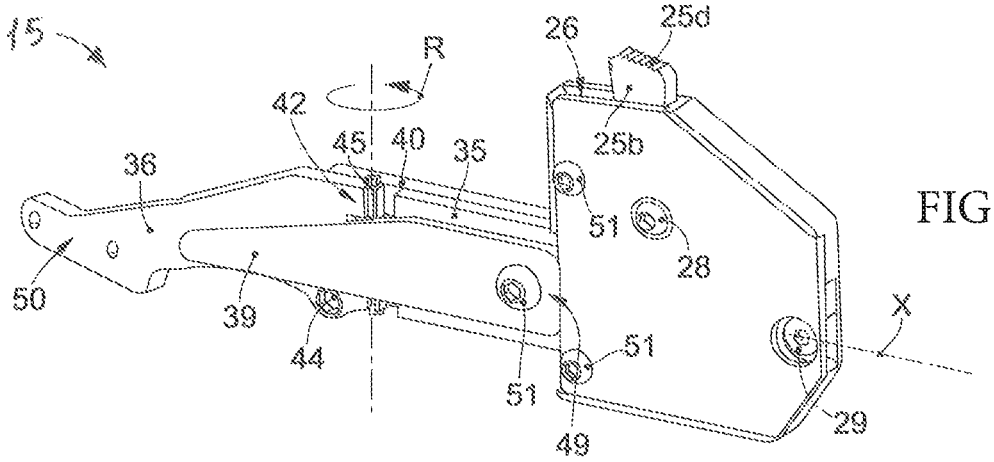
FIG. 17 is a schematic perspective view of a coupling device, in a hooked configuration, in accordance with embodiments of the present invention.

In embodiments exemplified by means of FIGS. 14 and 17, the end part of the first arm 25*b* can have a knurled section 25*d* , which allows a better grip and movement by the user. In embodiments, the chamber 21 also has a second opening 27, in which the connecting portion 34 of the support arm 16 is inserted.

The insertion of the support arm 16 into the housing assembly 17 therefore provides that the support arm 16 is inserted into the second opening 27 of the chamber 21 along the insertion axis X, until the connecting portion 34 comes into contact with the locking member 25, for example the second arm 25*c* of the rotatable lever 25*a,* arranged in the first operating position. As schematically illustrated in FIG. 15, a thrust of the support arm 16 along the insertion axis X will then cause the elastic element 30 to flex, moving the locking member 25 to the second operating position, and allowing the insertion of the support 16.

The insertion stop of the support arm 16 will therefore be determined by the stop of the seat with a concave profile 33 against the limit stop pin 29 and/or by the stop of the stop portion 49 against the housing assembly 17, and by the simultaneous return of the locking member 25 in the first operating position, as schematically illustrated in FIG. 16.

In the event that the locking element 25 is the rotatable lever 25*a,* the second arm 25*c* is engaged in the engagement seat 32, preventing retrograde movement of the support arm 16, once inserted.

This feature therefore allows a firm and safe anchoring of the support arm 16 in the housing assembly 17, and therefore the connection of the chin guard 14 to the cap 11.

The disengagement of the support arm 16 from the housing assembly 17, and therefore of the chin guard 14 from the cap 11, can be carried out by manually disengaging the locking member 25 from the support arm 16, for example by moving the first arm 25*b* of the rotatable lever 25*a* in the direction indicated by the arrow in FIG. 16.

Once the locking member 25 is positioned in the second operating position, the support arm 16 can be easily disconnected from the housing assembly 17.

The coupling device 15 thus configured allows therefore to releasably connect the half-chin guard 14 to the respective lateral extension 13*a,* 13*b,* allowing its insertion and disconnection along the insertion axis X.

Advantageously, this feature allows, in the event of an accident, to quickly free the user's face from the half-chin guard 14, also facilitating the removal of the helmet 10, once deprived of the half-chin guard 14, from the user's head.

This feature also requires less maneuvering space for the removal of the chin guard 14, and therefore of the helmet 10, compared to solutions that provide for the rotation of the half-chin guard 14, for example outwards or upwards.

This feature has the further advantage that the removal of the half-chin guard 14 does not require rotation and/or twisting movements of the head of the user of the helmet 10, which could cause or further aggravate any damage, injury, or vertebral trauma, for example at the user's neck, reported following an accident.

It is also obvious that the present invention provides embodiments described by the combination of FIGS. 14 and 18, in which it is possible to connect the half-chin guard 14 to the respective lateral extension 13*a,* 13*b* both in a releasable and in a slidingly mobile manner, allowing both the disengagement of the support arm 16 from the housing assembly 17, and the adjustment of the distance D.

In embodiments where the support arm 16 is made as an assembly, it can be configured as an articulated arm.

In such embodiments, the support arm 16 can rotate the half-chin guard 14 outwards.

In these embodiments, for example described by FIG. 14, the support arm 16 comprises a connection plate 35, connected to the respective lateral extension 13*a,* 13*b,* and an end plate 36, on which the half-chin guard 14 is fixed.

The connection plate 35 and the end plate 36 are hinged to each other to rotate the end plate 36 about an axis of rotation R, illustrated by way of example in FIGS. 15-18.

In particular, in these embodiments a hinge 42, or a hinge, or an articulation, or a pivot, or an articulated connection system can be provided, which allows the rotation of the end plate 36 with respect to the connection plate 35.

In these embodiments, the connection portion 34 previously described can be made at the end of the connection plate 35 opposite the hinge 42, as schematically illustrated in FIG. 14.

Furthermore, the hooking portion 50 previously described can be made at the end of the end plate 36 opposed to the hinge 42.

In embodiments described by FIG. 14, the hinge 42 can be defined by a joint portion 37, provided on the connection plate 35, a complementary joint portion 38, provided on the end plate 36, and by a pivot element 45, for example a pin, whose axis defines the rotation axis R.

In embodiments schematically described by FIG. 14, the complementary joint portion 38 is of the female type and has two spaced eyelets 41*a,* in the center of which an eyelet 41*a* associated with the conjugated joint portion 37, of the male type, is juxtaposed. between the eyelets 41*a* defining a pivot seat 41 for the pivot element 45.

In other embodiments, the joint portion 27 can be of the male type while the complementary joint portion 38 can be of the female type.

Variants are also possible in which the articulation portions 37, 38 provide an arbitrary number of eyelets 41*a,* of variable dimensions, arbitrarily spaced and complementary to each other to define the pivot seat 41.

Furthermore, the eyelets 41*a* can be made as holes passing through the respective joint portions 37, 38 or as open grooves, as shown in FIG. 14.

It is therefore possible to rotate the end plate 36 between a stable condition of normal use and a temporary extra-rotated condition.

In particular, it is possible to associate a first lying plane P to the joint portion 37 of the connection plate 35, and a second lying plane Q to the complementary joint portion 38 of the end plate 36, defining a normal use angle $\alpha$ such as 1 angle between the two lying planes P, Q.

In the stable condition of normal use, the respective joint portions 37, 38 of the connection plate 35 and of the end plate 36 lie on respective lying planes P, Q, defining between them the angle of normal use $\alpha$.

Figure 19:
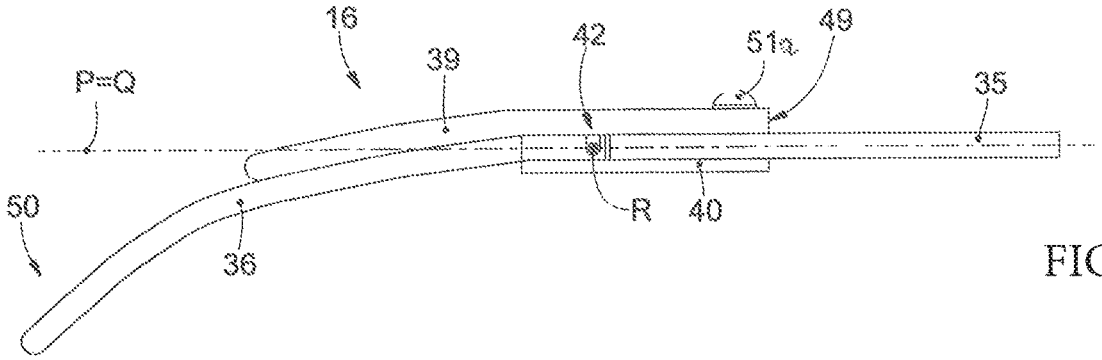
FIGS. 19-25 are schematic views of a coupling device according to embodiments of the present invention.
Figure 21:
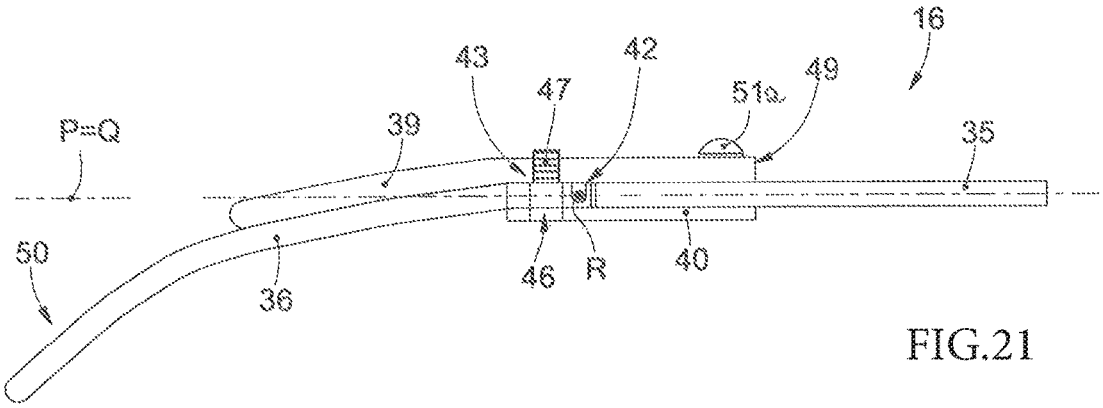

In the stable condition of normal use schematically described by FIGS. 19 and 21, the articulation portions 37, 38 of the plates 35, 36 are aligned with each other, the two lying planes P, Q are substantially coincident and the angle of normal use $\alpha$ assumes values substantially close to 0°.

Figure 22:
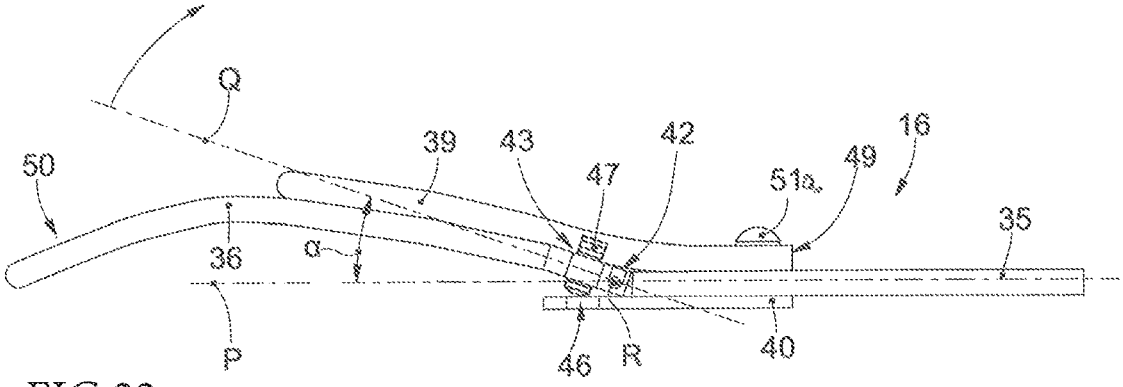
Figure 25:
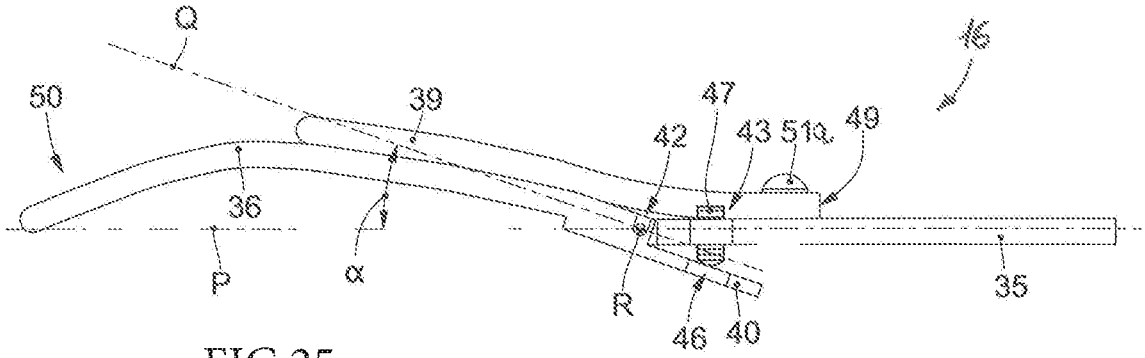

In the stable condition of normal use schematically described by FIGS. 22 and 25, the plates 35, 36 are not aligned with each other and the angle of normal use $\alpha$ can take values substantially between 0° and 180°.

Figure 12:
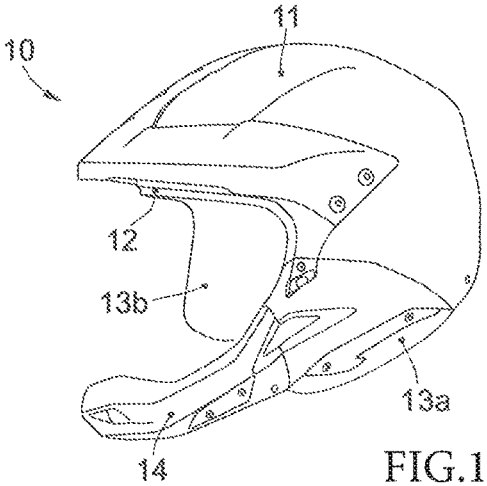

In the temporary extra-rotated condition, the end plate 36 is rotated laterally outwards with respect to the angle of normal use $\alpha$, and the lying planes P, Q define an extra-rotation angle $\beta$, different from the angle of normal use $\alpha$, schematically illustrated in FIGS. 12, 15 and 16.

Figure 20:
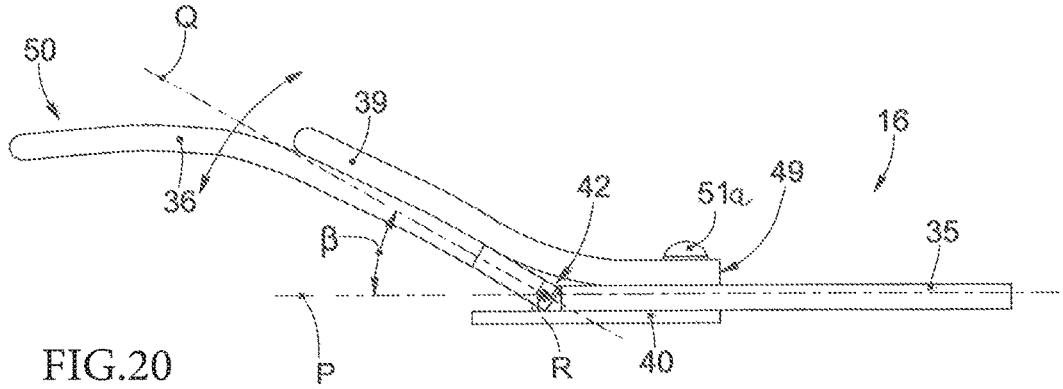

In the example described in FIGS. 19 and 20, the end plate 36 defines a normal use angle $\alpha$ substantially zero with respect to the connection plate 35, and can be temporarily extra rotated by an extra-rotation angle β.

In the example described by FIGS. 21 and 22, the end plate 36 defines a normal use angle α other than zero with respect to the connection plate 35, and can be temporarily extra rotated by an extra rotation angle β, greater than the angle of normal use α.

A rotation of the end plate 36 corresponds to a rotation of the half-chin guard 14 with respect to the lateral extension 13*a*, 13*b* on which it is mounted, as schematically illustrated in FIG. 12.

In the extra-rotated condition the angular position of the half-chin guard 14 is therefore temporarily changed with respect to the respective lateral extension 13*a*, 13*b*.

This feature allows, in the event of an accident, to prevent impulses and torsional movements of the helmet 10 due to an accidental attachment of the chin guard to elements present in the passenger compartment, such as for example steering spokes, seat belts, arms and/or also flying objects, thus improving the safety of the helmet 10.

This feature also allows you to quickly clear the user's face in an emergency, for example if, following an accident, rescuers need to apply a respirator.

This feature allows, for example, to be able to apply an oxygen mask on the user's face, quickly and easily, without breaking the half-chin guard 14 and/or helmet 10, thus avoiding the generation of splinters and/or free debris associated with rupture of the half-chin guard 14.

In embodiments schematically described by means of FIGS. 14, 19, 20, 21, 22, 23, 24 and 25, the support arm 16 further comprises an internal abutment portion 40, configured to block an inward rotation of the end plate 36 with respect to the connection plate 35, i.e. in the direction of the face of the user of the helmet 10, opposite to the outward rotation.

In particular, the internal abutment portion 40 blocks the rotations of the end plate 36 associated with negative values of utilization angles α.

In embodiments described by way of example in FIG. 14, the internal abutment portion 40 can be fixed on, or made in a single piece with, the connection plate 35.

Figure 24:
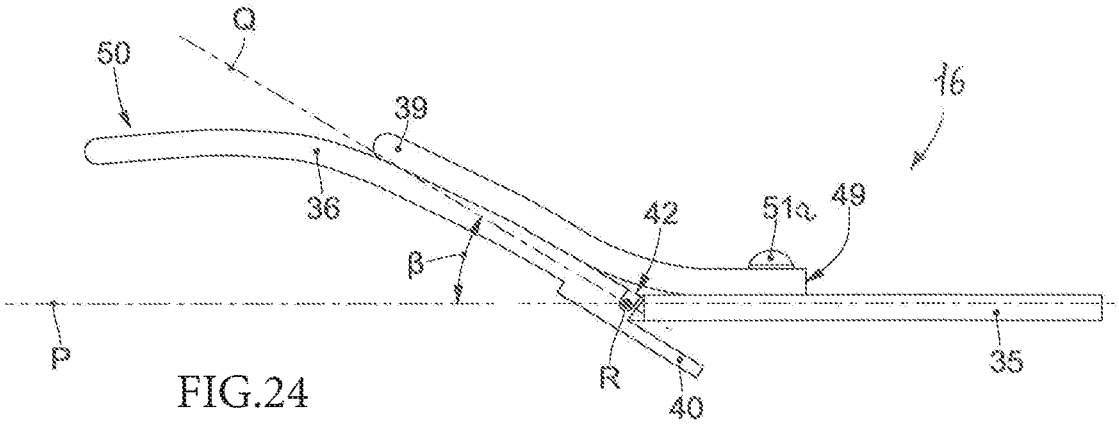

In alternative embodiments exemplified by means of FIGS. 24 and 25, the internal abutment portion 40 can be fixed on, or made in a single piece with, the end plate 36.

With reference to FIG. 12, this feature prevents the half-chin guard 14 from flexing towards the inside of the helmet 10, interfering with the user's face.

In embodiments, the support arm 16 can also comprise elastic means, configured to normally maintain the end plate 36 in the stable condition of normal use, restoring the stable condition of normal use when the end plate 36 is rotated outwards.

For example, this situation can occur in the operations performed by the user to wear the helmet 10.

In particular, the elastic means can be configured to restore the stable condition of normal use when the end plate 36 is rotated in the extra-rotated condition.

In embodiments described by FIGS. 14, 19, 20, 21, 22, 23, 24 and 25, the elastic means are configured as an elastic tongue 39, arranged externally astride the hinging regions of the joint portions 37, 38.

In embodiments, the elastic tongue 39 is made of polymeric material, in particular polycarbonate, and has a flexural elastic modulus comprised in a range between 1400 and 1600 N/mm$^2$, preferably between 1450 and 1550 N/mm$^2$.

In embodiments, the elastic tongue 39 can also have a flexural strength of between 70 and 110 N/mm$^2$, preferably between 80 and 100 N/mm$^2$.

For example, in embodiments, the elastic tongue 39 can have a flexural strength of 90 N/mm$^2$, and an elastic modulus of 1500 N/mm$^2$.

In embodiments, the elastic means are rigid enough to ensure solidity and robustness to the support arm 16 during normal use of the helmet 10, but flexible enough to allow the extra rotation of the half-chin guard 14 outwards in case of necessity.

The elastic means are also configured in such a way that the extra-rotation of the half-chin guard 14 towards the outside requires imparting a biomechanically adequate force, according to the regulations in force, so as not to harm the user.

The presence of the elastic means therefore allows the semi-chin guard 14 to be kept in the stable condition of normal use also as a result of the stresses that may occur during various sports, motor and non-motor practices, such as car or rally racing, autocross, snow mobiles, skiing, cross, MTB, etc.

Furthermore, when such embodiments are used in combination with the previously described variants, wherein the support arm 16 can be releasably or slidingly movable connectable to the housing assembly 17, an end portion of the elastic tongue 39 can perform the function of the stop portion 49, and therefore the elastic tab 49 can also perform the function of defining the limit stop for inserting the support arm 16.

In embodiments, the support arm 16 also includes adjustment means 43, for adjusting the angular position of the end plate 36, so as to permanently define the stable condition of normal use of the half-chin guard 14 with respect to the respective lateral extension 13*a*, 13*b*.

In particular, the adjustment means 43 are designed to adjust the angle of normal use α.

In embodiments described by way of example in FIG. 14, the adjustment means 43 can be arranged on the end plate 36, and the internal abutment portion 40 can be fixed by means of fixing means 51, for example a fixing screw 51*a*, to the connection 35 on the inside of the helmet 10, i.e. on the side facing the user's face.

In alternative embodiments, not shown in the figures, the internal abutment portion 40 can also be made in a single piece with the connection plate 35.

In these embodiments, the angular adjustment means 43 can comprise an adjustment dowel 47 which can be screwed into a threaded hole 44 made on the end plate 36, adapted to be rotated to progressively strike against a contrasting portion 46 of the portion internal stop 40, adjusting the angle of normal use α.

In embodiments illustrated by way of example in FIG. 25, the adjustment means 43 can be arranged on the connection plate 35, and the internal abutment portion 40 can be fixed to the end plate 36 by means of fixing means 51, for example a fixing screw 51*a*, or even made in one piece with the end plate 36.

In these embodiments, the angular adjustment means 43 can comprise the adjustment dowel 47 which can be screwed into a threaded hole 44 made on the connection plate 35, adapted to be rotated to progressively strike against the contrast portion 46 of the internal stop portion 40, adjusting the angle of normal use α.

Figure 13:
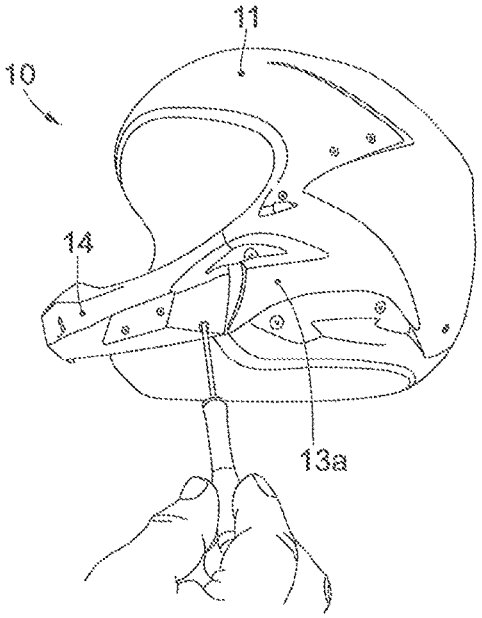
FIG. 13 illustrates an embodiment of the adjustment of the microphone in a protective helmet according to embodiments of the present invention.

In embodiments described by FIG. 13, a hole is provided in the half-chin guard 14, in a position coordinated with the position of the adjustment dowel 47, which allows the user to operate the adjustment dowel 47 from the outside, for example by means of a screwdriver, thus adjusting the angular position of the half-chin guard 14.

Furthermore, in cases where the half-chin guard includes a microphone, the previously described embodiments allow to adjust the distance of the microphone from the user's mouth. In particular, in the embodiments described by way of example in FIGS. 12, 22 and 25, the adjustment of the microphone can take place thanks to the adjustment means 43, which allow to adjust the angle of normal use α and therefore the angular position of the half-chin guard 14. In particular, in the embodiments described by way of example in FIGS. 10 and 18, the adjustment of the microphone can take place thanks to the presence of the plurality of engagement seats 32 in the support arm 16, which allows to adjust the distance D between the half-chin guard 14 and the respective lateral extension 13*a*, 13*b*.

Figure 23:
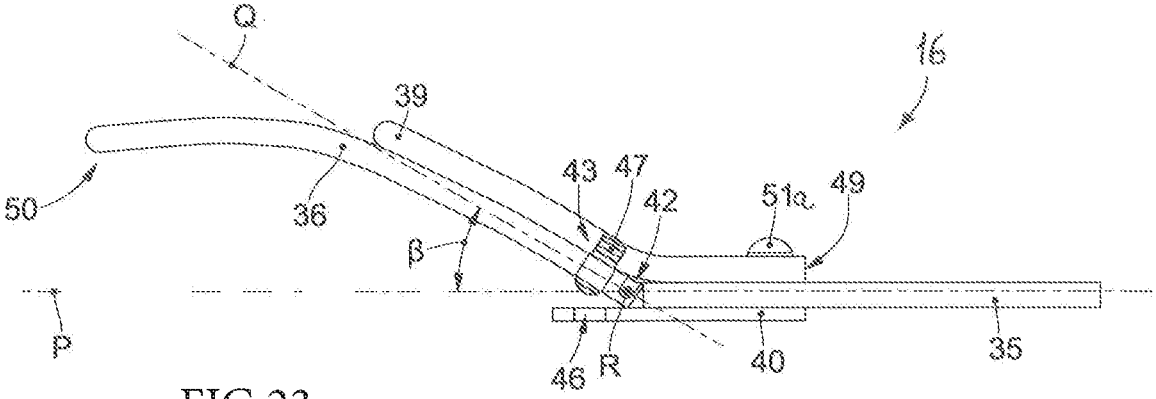

The present invention also provides embodiments which are described by way of example in FIG. 23, in which both the hinging, which allows the half-chin guard 14 to be rotated outwards, defining the extra-rotation angle β, that the means of adjustment 43, which allow to adjust the angle of normal use α.

Furthermore, in embodiments described by the combination of FIGS. 10 and 18 with FIGS. 12, 22 and 25, it is possible to connect the half-chin guard 14 to the respective lateral extension 13*a*, 13*b* in a slidingly movable way, adjusting the distance D, and adjust the angle of normal use α of the half-chin guard 14 with respect to the respective lateral extension 13*a*, 13*b*.

Furthermore, in embodiments described by means of the combination of FIGS. 14 and 18 it is possible to connect the half-chin guard 14 to the respective lateral extension 13*a*, 13*b* in a slidingly movable manner, and to provide for the hinging which allows to rotate the half-chin guard 14 outwards.

Furthermore, in exemplary embodiments described by FIG. 14, it is possible both to connect the chin guard 14 to the respective lateral extension 13*a*, 13*b* in a releasable way, and to provide for the hinging that allows the half-chin guard 14 to rotate outwards.

Furthermore, in embodiments described by way of example by means of FIG. 14 it is possible both to connect the chin guard 14 to the respective lateral extension 13*a*, 13*b* in a releasable way, and to provide the adjustment means 43 which allow to adjust the angle of normal use α of the seed—cement mixer 14 with respect to the respective lateral extension 13*a*, 13*b*.

It is therefore evident from the previous description that the protective helmet according to the present invention allows to solve the problems of the communication systems in the automotive field of the devices of the known type, also improving the aspects of safety and practicality of use. All with a mechanism that is relatively easy to manufacture and certainly simplified to use. Based on the given description, other features, modifications or improvements are possible and evident to the average technician. Such characteristics, modifications and improvements are therefore to be considered part of the present invention. In practice, the materials used, as well as the contingent shapes and dimensions, may be any according to the requirements and the state of the art.

The invention claimed is:

1. A protective helmet comprising:

a cap configured for wrapping a portion of a user's skull, wherein a front opening is provided in correspondence with at least a portion of said user's face and said front opening is delimited by an upper edge and by a first and second lateral edge of said cap, wherein said cap comprises:

a second reversible coupling positioned in said cap at said first lateral edge and/or said second lateral edge;

a detachable arm further comprising:

a first element provided with a first reversible coupling adapted to rigidly couple with the second reversible coupling, and a second element flexibly coupled to said first element and which extends from said first element in a direction of a central and lower part of said front opening and is adapted to support a microphone reversibly fixed to said cap at said first lateral edge and/or said second lateral edge;

a third element comprising an elastic tongue and operatively connected to said first element and said second element;

an abutment portion arranged at an internal side of the first element or the second element and adapted to block an inward rotation of the second element;

said first element comprising a first body having a first end on which said first reversible coupling is positioned and a second end on which said second element of said detachable arm is pivotable;

said third element is arranged externally astride the second end of the first element and the second element and is configured to keep said second element in a fixed operating position with respect to said first element and with respect to said cap, said second element being rotatably movable between said fixed operating position and a non-operative position overcoming resistance of said third element comprising said elastic tongue.

2. The protective helmet of claim 1, wherein said third element comprises a strip of flexible material having first and second ends respectively connected to said first and second elements of said detachable arm.

3. The protective helmet of claim 1, wherein said second element of said detachable arm is pivoted on said first element and is free to rotate with respect to said first element, around a rotation axis, between a stable condition of normal use and a temporary extra-rotated condition, temporarily varying the angular position of said second element with respect to said first lateral edge and/or said second lateral edge.

4. The protective helmet of claim 1, comprising an adjustment dowel for adjusting said fixed operating position of said second element of said detachable arm.

5. The protective helmet of claim 1, wherein said second element of said detachable arm is movable between a fixed operating position with respect to said first element of said detachable arm and with respect to said cap and non-operative positions in which said second element is spaced anteriorly with respect to said cap.

6. The protective helmet of claim 4, wherein said adjustment dowel is arranged in the third element and one of the first element or the second element.

7. The protective helmet of claim 5, comprising an adjustment dowel for adjusting said fixed operating position of said second element of said detachable arm.

8. The protective helmet of claim 1, wherein said second reversible coupling are positioned in said cap in correspondence with said first and said second lateral edge of said front opening.

9. The protective helmet of claim 1, wherein said second reversible coupling comprise a fixing plate positioned on said cap and provided with a seat for housing said first element of said deteachable arm.

10. The protective helmet of claim 1, comprising release means associated with the detachable arm for disengaging said first reversible coupling from said second reversible coupling.

11. A protective helmet comprising:

a cap configured for wrapping a portion of a user's skull, wherein a front opening is provided in correspondence with at least a portion of said user's face and said front opening is delimited by an upper edge and by a first and second lateral edge of said cap, wherein said cap comprises:

a second reversible coupling positioned in said cap at said first lateral edge and/or said second lateral edge;

a detachable arm further comprising:

a first element provided with a first reversible coupling adapted to rigidly couple with the second reversible coupling, and a second element flexibly coupled to said first element and which extends from said first element in a direction of a central and lower part of said front opening and is adapted to support a microphone reversibly fixed to said cap at said first lateral edge and/or said second lateral edge;

a third element comprising an elastic tongue and operatively connected to said first element and said second element;

an adjustment dowel for adjusting a fixed operating position of said second element of said detachable arm;

said first element comprising a first body having a first end on which said first reversible coupling is positioned and a second end on which said second element of said detachable arm is pivotable;

said third element is configured to keep said second element in the fixed operating position with respect to said first element and with respect to said cap, said second element being rotatably movable about a single axis of rotation between said fixed operating position and a non-operative position overcoming resistance of said third element comprising said elastic tongue;

said adjustment dowel is arranged in the third element and one of the first element or the second element.

12. The protective helmet of claim 11, wherein said third element comprises a strip of flexible material having first and second ends respectively connected to said first and second elements of said detachable arm.

13. The protective helmet of claim 11, herein said second element of said detachable arm is pivoted on said first element and is free to rotate with respect to said first element, around the single axis of rotation, between a stable condition of normal use and a temporary extra-rotated condition, temporarily varying the angular position of said second element with respect to said first lateral edge and/or said second lateral edge.

14. The protective helmet of claim 11, wherein said second reversible coupling are positioned in said cap in correspondence with said first and said second lateral edge of said front opening.

15. The protective helmet of claim 11, wherein said second reversible coupling comprise a fixing plate positioned on said cap and provided with a seat for housing said first element of said deteachable arm.

16. The protective helmet of claim 11, comprising release means associated with the detachable arm for disengaging said first reversible coupling from said second reversible coupling.

* * * * *